United States Patent [19]

Ikonomou

[11] 4,269,011

[45] May 26, 1981

[54] EARTHQUAKE GUARDING SYSTEM

[76] Inventor: Aristarchos S. Ikonomou, 90 Evrou St., Athens 609, Greece

[21] Appl. No.: 46,760

[22] Filed: Jun. 8, 1979

[51] Int. Cl.[3] ..... E02D 27/34

[52] U.S. Cl. ..... 52/167; 52/98

[58] Field of Search ..... 52/167, 98, 573; 248/548, 563

[56] References Cited

U.S. PATENT DOCUMENTS

| | | | |
|---|---|---|---|
| 2,968,458 | 1/1961 | Moeller | 52/167 |
| 3,212,745 | 10/1965 | Lode | 52/167 X |
| 3,638,377 | 2/1972 | Cuspe | 52/167 |
| 3,794,277 | 2/1974 | Smedley et al. | 52/167 X |
| 4,166,344 | 9/1979 | Ikonomou | 52/167 |

OTHER PUBLICATIONS

*To Alexisiesmon*, "The Earthquake Guarding System", 1972, Dr. A. S. Ikonomou.

*Primary Examiner*—Price C. Faw, Jr.

*Assistant Examiner*—Carl D. Friedman

*Attorney, Agent, or Firm*—Cushman, Darby & Cushman

[57] ABSTRACT

An earth quake resistant structure having a superstructure and at least one load distributing base supporting said superstructure, the connections between said structure and the earth being essentially a support means and a connecting means, said support means transferring to the ground the load of the structure in a first direction from said load distributing base, said support means providing elastic resistance to movement of the structure in all directions perpendicular to said first direction so that said support means is able to follow dynamic movements of the ground in said perpendicular directions without transferring great forces from the ground to said base in said perpendicular directions, said structure being provided with peripheral clearance from the ground in said perpendicular direction so that said base can move a predetermined distance through said clearance relative to the ground in said perpendicular direction.

3 Claims, 2 Drawing Figures

EARTHQUAKE GUARDING SYSTEM

The present invention relates to a system for protecting a construction from the destructive forces of an earthquake or of one explosion etc. It utilizes the principles of my U.S. Pat. application, Ser. No. 783,310, filed Mar. 31, 1977. The present invention provides a mechanism for connecting the construction to the earth until it is exposed to great seismic forces. This mechanism may be utilized instead of the bars described in my previous application. For certain situations described below, my new mechanism is advantageous.

BACKGROUND OF THE INVENTION

The destruction caused by earthquakes mainly arises from the horizontal components of the oscillation of the earth. These components impose very large shear forces on constructions. When those forces exceed the strength of one structural member, this member is damaged.

In my previous patent application, I described a system for isolating a construction from the earth when horizontal seismic forces exceed a predetermined value. The system includes a base, usually of reinforced concrete, supports which carry the weight or load of the construction and impose elastic forces on the construction which react against horizontal movement, and connecting means which prevent horizontal movement of the construction under normal circumstances, for example, when the building is subjected to forces from winds.

In the specific embodiment described in my previous application, the connecting means is comprised of elongated bars, which are attached to the base and to the ground. The bars are primarily of large diameter but have a short segment of small diameter. The bars are attached in such a way that they are in tension at all times. If the structure is subjected to great horizontal forces, the tensile strength of the short segment is exceeded and it breaks. This releases the construction so that it may oscillate freely, under the influence of the elastic forces described above, somewhat like a giant pendulum.

The means for attaching the bars described in my previous application is comprised of a post which extends upwardly through an opening in the base and anchorages which attach the bars to the base and to the post. Once the bars break, the base can move relative to the post, within the limitations imposed by the size of the opening in the base through which the post projects.

In certain locations, the anticipated oscillations of the base are very great and therefore the opening must be quite large. However, in certain constructions, such large openings cannot be accepted. For example, in a concrete bridge, a large opening in the deck might be needed which would not be acceptable for reasons of economy, because vehicles travel over the deck and therefore the bridging of the openings is very expensive. Also it would be necessary to overcome great practical design difficulties even if the bars are arranged under the deck.

SUMMARY OF THE INVENTION

The present invention provides a connecting means which does not require a post extending upwardly into the base, and which requires a minimum of space. Furthermore, the new connecting means fractures below the base so that the base can oscillate then without restraint. Briefly, the connecting means in accordance with the present invention comprises a bar which is connected to the ground below the base and extends vertically into an opening, preferably an elongated slot, in the base. This bar allows only limited horizontal movement until a predetermined force is encountered. It then breaks by a shearing action, below the base, and the part of the bar extending up into the base may be allowed to drop from the opening. The base is then free to oscillate until the bar is replaced.

BRIEF DESCRIPTION OF FIGURES IN DRAWING

The preferred embodiment of the invention will be described by reference to the drawing, in which:

FIG. 1 is a perspective which illustrates construction utilizing the present invention; and FIG. 2 is an enlarged view of a bar utilized in the construction of FIG. 1, showing in part how it is connected with the construction.

DETAILED DESCRIPTION OF PREFERRED EMBODIMENTS

Figure 1:
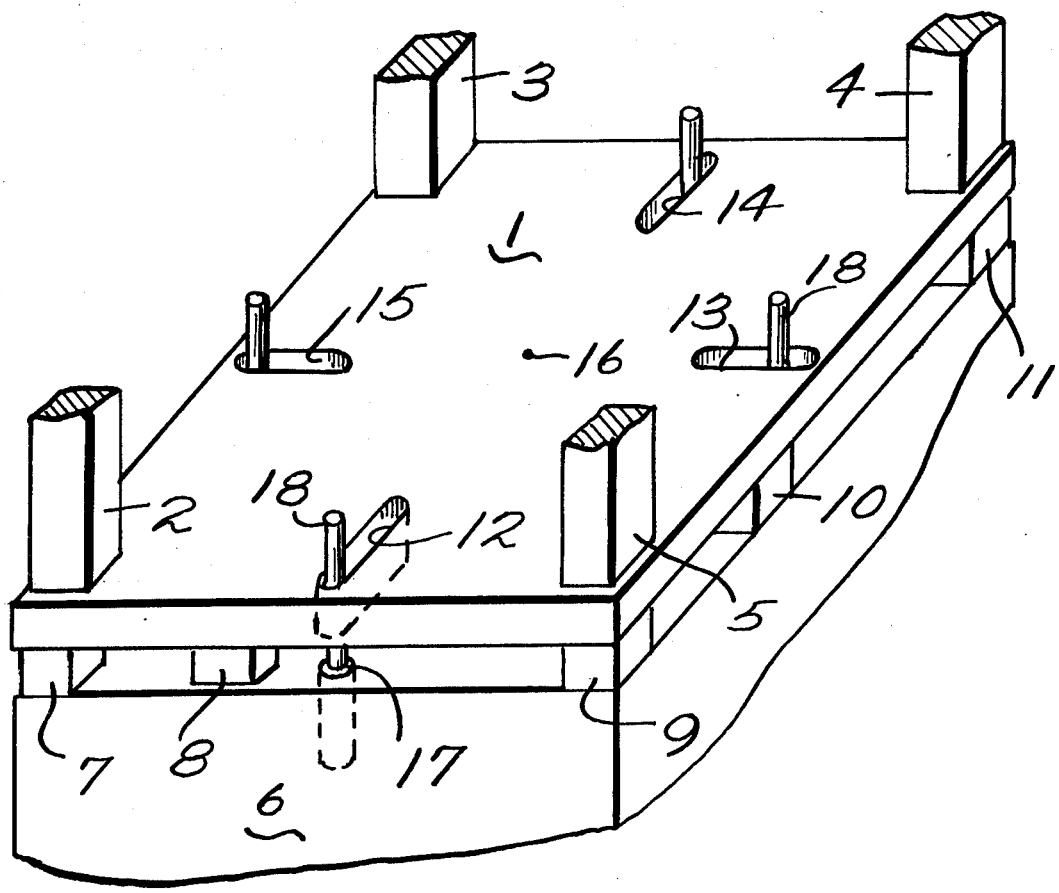

The construction illustrated in the drawing is a concrete building comprised of a reinforced concrete base 1 and columns 2, 3, 4, 5. The remainder of the building which is supported on the columns is conventional and therefore has not been illustrated.

Below the base is a foundation 6, which for present purposes is considered part of the ground. The foundation may be a concrete slab, or several independent piers, or some other structure, depending on the location, the kind of construction, etc.

Between the base 1 and the foundation 6 there are bearings 7, 8, 9, 10, 11 which collectively constitute the support for the base. These bearings may be elastomeric bearings which are connected to the base 1 and the foundation 6, for example laminated bearings of the type having steel plates alternating with layers of natural or polychloroprene rubber. Sliding bearings comprised of polytetrafluoroethylene (Teflon) surfaces, or roller bearings may be used at some locations, to support all or part of the vertical load, provided only that sufficient springs, rubber bearings or the like are used. It is required that these latter components of the connecting means offer elastic resistance to movement of the sturcture in horizontal directions. These components must have (1)sufficient elastic stiffness to apply the necessary restoring forces to the structure and (2) sufficient strength to safely transfer the loads in the horizontal direction from the structure to the ground (for example, the windloads).

Figure 2:
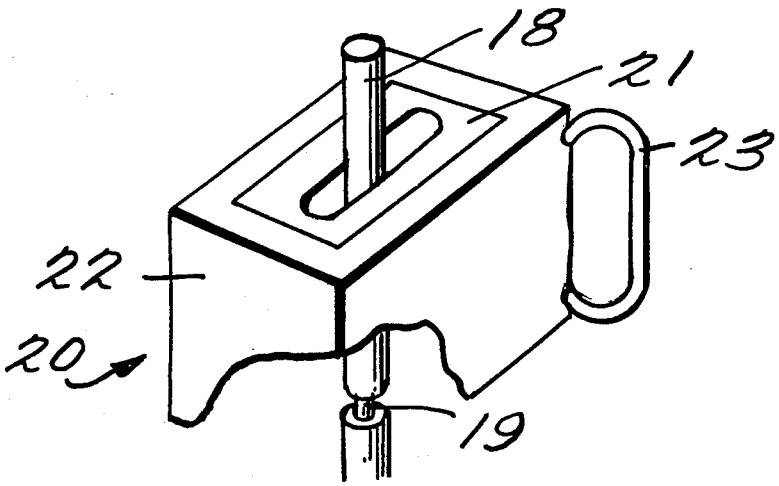

In the embodiment illustrated, there are four elongated slots 12, 13, 14 and 15 extending vertically through the base 1. Each is at the midpoint along one of the four sides of the base 1, and their center lines are oriented so that they meet at a common point 16 within the base 1. It is possible to provide more than four slots, but their center lines should all meet at a common point, for reasons to be explained below. Below each slot, there is a reinforced vertical opening 17 in the foundation 6, which preferably is lined with a steel tube. The opening 17 receives a bar 18 which extends vertically through slot 12. If desired, the steel tube within opening 17 may extend upwardly to a location just below the base 1, enclosed if desired in a small concrete column, to help localize the position on bar 18 which fractures during movement between the base 1 and the foundation 6. As seen in FIG. 2, the bar 18 may have a small diameter neck 19, which may for example be located just below the base 1, which will fracture preferentially when an earthquake occurs.

The slots 12, 13, 14, 15 preferably are lined with a steel casing 20 having a slot which has parallel sides and rounded ends, the slot having a width equal to the diameter of the bar 18. If desired, lubricant or an anti-friction coating may be applied to facilitate sliding motion between the bar and the casing. In a preferred form, the steel casing 20 is comprised of a steel liner 21 which is removable and a steel housing 22 which is anchored to the concrete through concrete anchors 23.

The length of the slot 12 is sufficient for normal movement of the construction. Allowance must be made for movement caused by thermal expansion and contraction, shrinkage of the concrete and contraction caused by prestressing and the like. Small movements may also occur from wind forces. Through the use of longitudinal slots whose directions meet at a common point, thermal expansion is allowed in all directions within the plane constituting the base 1, but in each slot movement is allowed only in one direction. In this embodiment, the slots are perpendicular to each other and at the midpoints of the sides of the base. However, as will be self-evident, this is not essential.

The diameter of the bars is calculated on the basis of shear breaking stress of the bars in accordance with the equation $$f = p/\alpha$$

where "p" is the predetermined maximum force which has to be transferred by each bar, "f" is the cross-sectional area of the bar and "$\alpha$" the shear breaking stress for the material of which the bar is composed. In the case of the preferred embodiment, the diameter "d" of the neck 19 is given by the equation:

$$d = 2\sqrt{\left(\frac{p}{\pi\alpha}\right)}$$

The force "p" corresponds to a shear force less than the force which would determine the structure. This shear force is called the "predetermined" force. Depending on applicable building codes which allow various safety factors, it may be, e.g., 50% of the force which would damage the construction.

The bar 18 may slide into the reinforced vertical opening 17 in foundation 6, or it and the opening 17 may be threaded to be secured together. After an earthquake, the remainder of the bar is removed from the opening 17 and replaced with a new bar. If the structure has moved slightly from its normal position, the steel liner 21 may be removed to assist in inserting the bar and the structure may be jacked back to its normal position if necessary. Alternatively, the liner may be replaced with another one whose slot is slightly displaced or the housing 22 may be removed from the concrete base and repositioned. Various other arrangements to deal with this situation will be obvious.

It will be apparent that, instead of the arrangement shown, slots may be provided in the foundation 6 rather that in the base 1. In addition, instead of one bar in each slot, two, three or more may be used.

In a construction it is possible for ONLY one of the connecting breakable means to be firmly connected with both the ground and base, i.e., without having the property of movement in a horizontal direction. But in such a case the directions of movement of the other connecting elements must meet each other in the place of the above connecting element In the foregoing description, the words "vertical" and "horizontal" have been used because, in most constructions, the load of the structure is vertical. However, in certain situations, the load is not vertical. In such cases, the load is in a first direction and the bar 18 controls movement in a second direction which is perpendicular to the first direction.

What is claimed is:

1. In a structure having a superstructure and at least one load distributing base supporting said superstructure, the connections between said structure and the earth being essentially a support means and a connecting means, said support means transferring to the ground the load of the structure in a first direction from said load distributing base, said support means providing elastic resistance to movement of the structure in all directions perpendicular to said first direction so that said support means is able to follow dynamic movements of the ground in said perpendicular directions without transferring great forces from the ground to said base in said perpendicular directions, said structure being provided with peripheral clearance from the ground in said perpendicular directions so that said base can move a predetermined distance through said clearance relative to the ground in said perpendicular directions, said connecting means being connected respectively to said base and to the ground in a said perpendicular direction, said connecting means being sufficiently strong to substantially prevent movement of said structure under forces in said perpendicular directions less than a predetermined magnitude but sufficiently weak to abruptly disconnect the connection between the ground and the base immediately upon being subject to a force of said predetermined magnitude when said base has moved a small proportion of said predetermined distance in said perpendicular direction, thereby removing the restraint against movement of the structure in said perpendicular direction by removing the transmission of forces in said perpendicular direction through said connecting means so that the load of said structure remains supported on said support means which thereafter provides the only essential connection to the ground, said support means having sufficient elastic stiffness in said perpendicular direction to apply restoring forces to said sturcture and to safely transfer loads in said perpendicular direction from the structure to the ground, after said connecting means has disconnected, thereby permitting the structure to move relative to the ground in said perpendicular direction through said peripheral clearance against the elastic resistance of said support means and in accordance with abruptly changed dynamic characteristics and to withstand said dynamic movements of the ground;

the improvement in which said connecting means comprises an elongated bar connected to said load distributing base and to the ground, the long dimension of said bar extending in said first direction, said bar being subjected to shear forces during relative movement between said base and the ground and being constructed and arranged to break in shear when subjected to said force of predetermined magnitude, and in which there is an elongated slot in said base having a width approximately the same as said bar, which receives said bar, whereby movement of said base relative to said bar can occur along the length of said slot.

2. A structure as set forth in claim 1 having a plurality of said bars and said slots, said slots being oriented towards a common point in said base.

3. A structure as set forth in claim 2 in which said bar has a section along its length whose cross-sectional area is less than the cross-sectional area of the rest of the bar, whereby said section will break in preference to other parts of said bar when the structure is subjected to said force of predetermined magnitude.

* * * * *